US009595410B2

(12) United States Patent
Watford

(10) Patent No.: US 9,595,410 B2
(45) Date of Patent: Mar. 14, 2017

(54) CIRCUIT BREAKER INCLUDING ADJUSTABLE INSTANTANEOUS TRIP LEVEL AND METHODS OF OPERATING SAME

(71) Applicant: Siemens Industry, Inc., Alpharetta, GA (US)

(72) Inventor: Russell Thomas Watford, Lawrenceville, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 31 days.

(21) Appl. No.: 14/791,574

(22) Filed: Jul. 6, 2015

(65) Prior Publication Data

US 2016/0260570 A1 Sep. 8, 2016

Related U.S. Application Data

(60) Provisional application No. 62/128,633, filed on Mar. 5, 2015.

(51) Int. Cl.

| | |
|---|---|
| ***H01H 37/52*** | (2006.01) |
| ***H01H 36/02*** | (2006.01) |
| ***H01H 71/40*** | (2006.01) |
| ***H01H 71/74*** | (2006.01) |
| *H01H 89/00* | (2006.01) |

(52) U.S. Cl.

CPC ..... *H01H 37/52* (2013.01); *H01H 36/02* (2013.01); *H01H 71/405* (2013.01); *H01H 71/7463* (2013.01); *H01H 89/00* (2013.01)

(58) Field of Classification Search

CPC ..... H01H 89/00; H01H 36/02; H01H 37/52; H01H 2235/01

See application file for complete search history.

(56) References Cited

U.S. PATENT DOCUMENTS

| | | | | |
|---|---|---|---|---|
| 3,372,354 | A | 3/1968 | Myers | |
| 4,479,101 | A | 10/1984 | Checinski | |
| 4,630,017 | A | 12/1986 | Young | |
| 4,698,606 | A * | 10/1987 | Mrenna | H01H 71/7427 335/45 |
| 4,922,220 | A * | 5/1990 | Livesey | H01H 71/74 335/45 |
| 6,030,114 | A | 2/2000 | DiMarco | |
| 6,255,925 | B1 | 7/2001 | DiMarco | |
| 6,445,274 | B1 * | 9/2002 | Malingowski | H01H 71/7445 335/202 |

(Continued)

*Primary Examiner* — Mohamad Musleh

(57) ABSTRACT

A circuit breaker including an adjustable instantaneous trip level. Adjustable instantaneous trip level can be applied to a one-pole and/or two-pole circuit breakers including a thermal and magnetic mechanism, including AFCI, CAFCI, and/or GFCI constructions. The circuit breaker includes a magnet position adjustment mechanism allowing an operator to adjust the instantaneous trip level to a desired setting, such as between about 5 to 10 times the handle rating. The design also allows for alternate magnets to be used for either an increased or decreased instantaneous settings as desired. In two-pole circuit breakers, the instantaneous trip level can be set independently for each mechanism pole. Multi-pole circuit breakers and methods of adjusting instantaneous trip level are provided, as are other aspects.

17 Claims, 12 Drawing Sheets

(56) References Cited

U.S. PATENT DOCUMENTS

| | | | | |
|---|---|---|---|---|
| 2003/0197581 | A1* | 10/2003 | O'Keeffe | H01H 71/2436<br>335/172 |
| 2009/0205941 | A1* | 8/2009 | Watford | H01H 71/0271<br>200/337 |

* cited by examiner 114
114F
252
338
348
114
114F
252
338
348
116

252
114
453

116
823
d
824

CIRCUIT BREAKER INCLUDING ADJUSTABLE INSTANTANEOUS TRIP LEVEL AND METHODS OF OPERATING SAME

RELATED APPLICATION

This application claims priority to U.S. Provisional Patent Application Ser. No. 62/128,633 filed on Mar. 5, 2015, and entitled "ADJUSTABLE INSTANTANEOUS TRIP FOR A ONE OR TWO-POLE RESIDENTIAL CIRCUIT BREAKER DESIGN," the disclosure of which is hereby incorporated by reference in its entirety herein.

FIELD

The present invention relates generally to circuit breakers, and more particularly to adjustability of certain performance parameters of circuit breakers.

BACKGROUND

Conventional residential circuit breakers include a molded case having multiple case pieces (e.g., halves or thirds) forming one or more internal cavities that are configured to accept the various internal circuit breaker components. Some circuit breakers, such as all mechanical single-pole circuit breakers, may include a mechanism pole with a first and second molded case piece housing the internal tripping mechanism components therein. In two-pole electronic circuit breakers, such as ground fault circuit interrupters (GFCIs) type and combination arc fault circuit interrupters (CAFCI) type residential two-pole circuit breakers, an electronic pole may be sandwiched between two mechanism poles. In each case, the mechanism poles may include a moveable contact arm with an attached moveable electrical contact, a stationary electrical contact mounted to the molded case, and a tripping mechanism adapted to separate the stationary and moveable electrical contacts when tripped.

Conventionally, in one mode of operation, the tripping mechanism allows for manual tripping via throwing a handle of the circuit breaker, but also includes a bi-metal and magnet mechanism that allows for: 1) tripping of the circuit breaker in a thermal mode by motion of the bimetal of a bimetal and magnet mechanism engaging an armature due to internal resistive heating due to a persistent overcurrent situation, and 2) for instantaneous tripping due to high current through the bimetal and magnet mechanism of a magnitude of 5× or more than the rated handle current of the circuit breaker.

During an instantaneous tripping event, the armature is magnetically attracted to the magnet by magnetic forces generated in the magnet due to the conductance of the high current through the current path including the bimetal. Instantaneous level, as used herein, is the current level at which the circuit breaker will trip due to the abnormally high current (e.g., 5× current) passing through the circuit breaker. As the armature rotates, the latch bite of a latch between the armature and a cradle of the tripping mechanism is decreased. Eventually, when the latch bite gets very small, the cradle is disengaged from the armature and the tripping mechanism will trip. Upon tripping, the moveable and stationary electrical contacts will separate creating an electrical open in the protected branch circuit.

In existing circuit breaker designs, the magnet is typically welded to the bimetal and the magnet. Because the magnet is welded to the bimetal, the air gap that exists between the magnet and armature is dependent on the bimetal position in the molded case. However, the position of the bimetal may vary due to the welding operations involved in the assembly process. Each time the bimetal is heated to create a welded joint, the bimetal is damaged in the localized areas and may warp and move. Additionally, the bimetal may be welded to connect the load terminal and current braid. Welding processes are controlled by weld parameters for the welding machine, but typically have a relatively large range to work within and thus variations of the bi-metal configuration may occur.

Because of the possibility of warping, once the welding has been completed, the circuit breaker is thermally calibrated to ensure desired thermal tripping is actually achieved, depending on circuit breaker type. Calibration may be accomplished by adjusting a calibration screw of a thermal calibration mechanism coupled to a portion of the conductive path, such as by adjusting a position of a strap coupled to the bimetal.

However, calibration of the thermal tripping may inadvertently change the instantaneous level of the circuit breaker. Accordingly, circuit breakers that can achieve more reliable instantaneous trip level are desired.

SUMMARY

In a first aspect, a circuit breaker is provided. The circuit breaker includes a mechanism pole containing a thermal and magnetic mechanism including a bimetal, magnet, and armature, a thermal calibration mechanism configured to adjust thermal tripping of the circuit breaker, and a magnet position adjustment mechanism configured to provide an adjustable instantaneous trip level via moving the magnet to allow adjustment of an air gap between the magnet and the armature.

In another aspect, a two-pole circuit breaker is provided. The two-pole circuit breaker includes a first mechanism pole containing a first thermal and magnetic mechanism including a first bimetal, first magnet, and first armature, and a first magnet position adjustment mechanism configured to provide an adjustable instantaneous trip level of the first mechanism pole via movement of the first magnet to adjust a first air gap between the first magnet and the first armature; and a second mechanism pole containing a second thermal and magnetic mechanism including a second bimetal, second magnet, and second armature, and a second magnet position adjustment mechanism configured to provide an adjustable instantaneous trip level of the second mechanism pole via movement of the second magnet to adjust a second air gap between the second magnet and the second armature.

In another aspect, a method of adjusting a circuit breaker is provided. The method includes providing a mechanism pole containing a thermal and magnetic mechanism including a bimetal, magnet, and armature, a thermal calibration mechanism, and a magnet position adjustment mechanism, and adjusting an instantaneous trip level by adjusting a position of the magnet with the magnet position adjustment mechanism to change an air gap between the magnet and the armature.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

BRIEF DESCRIPTION OF DRAWINGS

The drawings, described below, are for illustrative purposes only and are not necessarily drawn to scale. The drawings are not intended to limit the scope of the invention in any way. Wherever possible, the same reference numbers will be used throughout the drawings to refer to the same or like parts.

DESCRIPTION

Figure 1:
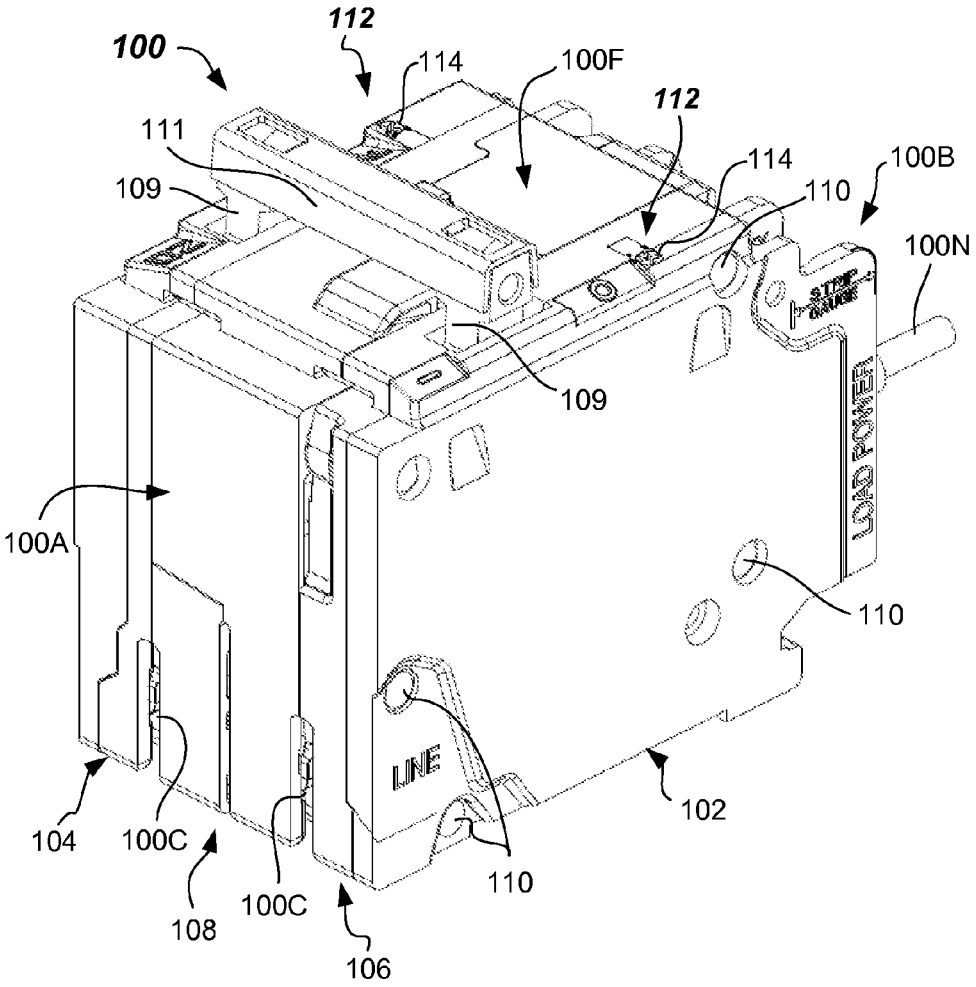
FIG. 1 illustrates an isometric view of a circuit breaker, such as a two-pole residential circuit breaker (e.g., GFCI or CAFCI), in accordance with one or more embodiments.

Reference will now be made in detail to the example embodiments of this disclosure, which are illustrated in the accompanying drawings.

In existing residential circuit breakers, the instantaneous level is not readily adjustable. Moreover, the inventors have recognized that the air gap between the magnet and armature dictates the instantaneous trip level and that the air gap may be quite variable from breaker-to-breaker for various reasons. Variability may arise in existing circuit breaker designs because, as discussed above, the welding operations that have taken place on the bimetal cause a bimetal position relative to the armature to be relatively inconsistent. This positional inconsistency can affect the air gap and therefore the instantaneous level of the circuit breaker.

For example, in existing CAFCI and/or GFCI 1-pole and/or 2-pole circuit breaker designs, the air gap between the magnet and armature is even more inconsistent because of the thermal calibration adjustment. The thermal calibration mechanism adjustment occurs in order to adjust the trip level of the circuit breaker due to low current causing heating of the bimetal to desired limits. Thus, the air gap is dependent on the bimetal position after this thermal calibration, which can result in an instantaneous trip level that is not consistent from circuit breaker to circuit breaker.

Additional embodiments of a circuit breaker including an adjustable trip level, various components thereof, and methods of adjusting an instantaneous trip level of a circuit breaker are described with reference to FIGS. 1-12 herein.

In one or more embodiments, the adjustment of instantaneous trip level is provided by a mechanism pole that includes a magnet position adjustment mechanism. The magnet position adjustment mechanism may include a rotating knob, rotating magnet carrier, and a magnet. The magnet position adjustment mechanism interfaces with other mechanism module components, such as an armature, and adjustment of the position of the magnet by the magnet position adjustment mechanism changes an air gap between the magnet and the armature. This changes the instantaneous trip level of the circuit breaker.

Embodiments of the invention may be used on one-pole or two-pole circuit breakers having thermal and magnetic mechanism and thermal/magnetic tripping capability. One or more embodiments of the invention allow independent adjustment, and thus influence over, the instantaneous level of each mechanism pole that are independent of thermal calibration.

Further details of embodiments of the circuit breaker including adjustable instantaneous trip level and components thereof are described with reference to FIGS. 1-12 herein.

Referring now to FIGS. 1-9, an embodiment of a two-pole circuit breaker 100 embodied as a GFCI or CAFCI and components thereof are shown and described. The circuit breaker 100 includes a molded case 102 including multiple poles, such as first mechanism pole 104, second mechanism pole 106, and an electronic pole 108. Each pole may be made up of multiple molded case pieces, which may be a polymer, such as a thermoplastic material. The various mechanism and electronic poles 104, 106, 108 may be assembled together using fasteners 110, such as rivets, screws, or the like.

The circuit breaker 100 may further include other conventional components, such as handles 109 and handle interconnector 111 on the front 100F of the circuit breaker 100, line side connectors 100C (e.g., c-clips) on the line side 100A, and a neutral conductor 100N (only a portion shown) on the load side 100B.

The circuit breaker 100 further includes adjustment of an instantaneous trip level thereof. Instantaneous trip level adjustment may be accomplished for one or both of the first mechanism pole 104 and the second mechanism pole 106. When used on both, instantaneous trip level adjustments may be made independently of one another. However, it should be apparent that instantaneous trip level adjustment in accordance with one or more embodiments may be advantageously incorporated on one-pole electronic circuit breakers, as well as on all mechanical one-pole and two-pole circuit breakers.

In one or more embodiments, adjustment of instantaneous trip level of the circuit breaker 100 may be accomplished by one or more magnet position adjustment mechanisms 112. Each of the magnet position adjustment mechanisms 112 in each respective mechanism pole 104, 106 are configured to provide an adjustable instantaneous trip level via moving a magnet 520 (FIG. 5) to allow adjustment of an air gap between a magnet 520 and an armature 522, as will be explained in detail herein.

Figure 2:
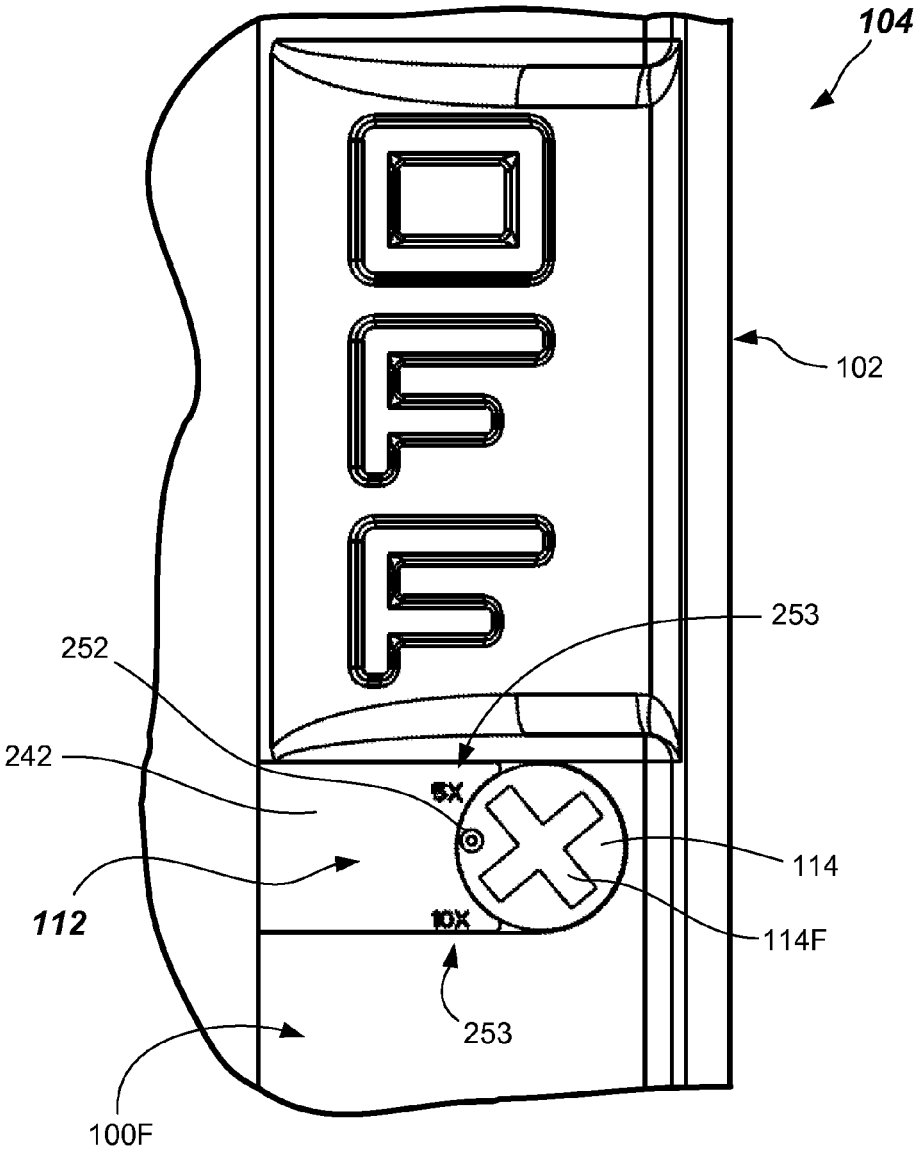
FIG. 2 illustrates a partial top plan view showing an adjustment knob providing external adjustment of an instantaneous trip level of the circuit breaker, such as between a 5× and a 10× handle rating, in accordance with one or more embodiments.
Figure 4:
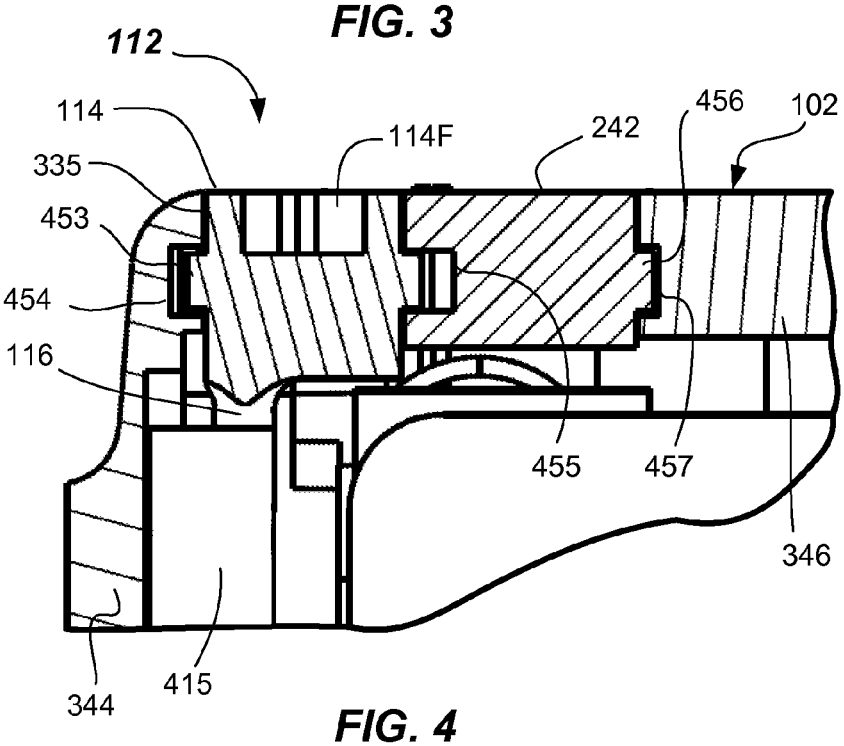
FIG. 4 illustrates a cross-sectioned partial side view of the adjustment knob interfacing with an adjustment knob block, magnet carrier and various other parts of the molded case according to one or more embodiments.
Figure 6:
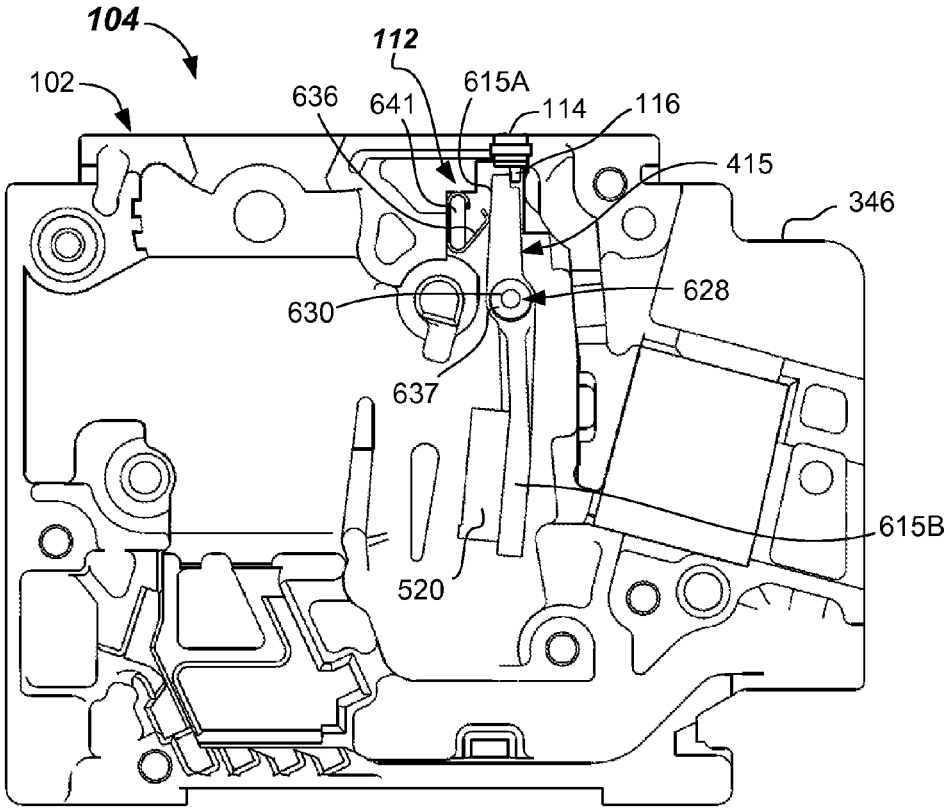
FIG. 6 illustrates a side view of the mechanism pole with the components of the magnet position adjustment mechanism shown according to one or more embodiments, with the components of the tripping assembly and other mechanism pole components being removed for clarity.

Magnet position adjustment mechanism 112 includes an adjustment knob 114 that is externally accessible and adjustable for each mechanism pole 104, 106. For example, as shown in FIGS. 1 and 2, each adjustment knob 114 is provided on a front 100F of the circuit breaker 100. As best shown in FIGS. 4, 6 and 8, the adjustment knob 114 includes a cam 116. Any suitable structure may be used for the cam 116 may be used, such as a post offset from a physical centerline of the adjustment knob 114. For example, the engaging surface 823 of the cam 116 that engages the magnet carrier 415 may be offset from the centerline 824 (the rotational axis) of the adjustment knob 114 by an offset distance "d." The offset distance "d" may be greater than about 0.50 mm, or even greater than about 0.58 mm, or even between about 0.50 mm and about 0.64 mm in some embodiments, for example. The adjustment knob 114 may include a turning feature 114F, such as Phillips head slot shown, or the like, that may be used to make the adjustment of instantaneous trip level. Other types of turning features 114F, such as slot head, hex head or socket, torx, or the like may be used. Adjustment knob 114 may be made of a suitably rigid material, such as a glass-filled polyester or nylon.

The magnet position adjustment mechanism 112 further includes a magnet carrier 415 including a pivot joint 628 and a first end 615A engageable with the cam 116 and a second end 615B opposite the first end 615A. Magnet carrier 415 may be made of a suitably rigid material, such as a glass-filled polyester or nylon. The second end 615B may include mounting features 726 that are configured to mount the magnet 520 onto the magnet carrier 415. Mounting features 726 may comprise one or more magnet carrier posts. However other fastening means, such as fasteners (screws or adhesive or combinations thereof) may be used.

The magnet 520 may include one or more holes 734 that may be received over the one or more mounting features 726 (e.g., magnet carrier posts). Magnet 520 may be attached to the magnet carrier 415 by press fit of the holes 734 onto the magnet carrier posts. Adhesive may be applied to the back side of the magnet 520 and a mating surface of the magnet carrier 415. Magnet may be U-shaped member manufactured from a magnetically-permeable material, such as cold-rolled steel. The magnet 520 may include a raised feature 520R for the armature 522 to contact.

In the depicted embodiment of FIG. 6, the magnet carrier 415 is mounted inside the mechanism pole 104 and is pivotable about a pivot joint 628. The pivot joint 628 may include a post 630 that may be formed integrally with the molded case 102, such as on the base 346, and that is configured to engage with an aperture 732 (FIG. 7B) formed in the magnet carrier 415. The post 630 and aperture 732 are appropriately sized to allow a close slip fit allowing the magnet carrier 415 to freely pivot on the post 630 relative to the molded case 102. Other types of pivot joints 628 may be used. A retaining member 637 may be received over and lock onto the post 630 to retain a lateral location of the magnet carrier 415 inside of the mechanism pole 104.

Figure 7A:
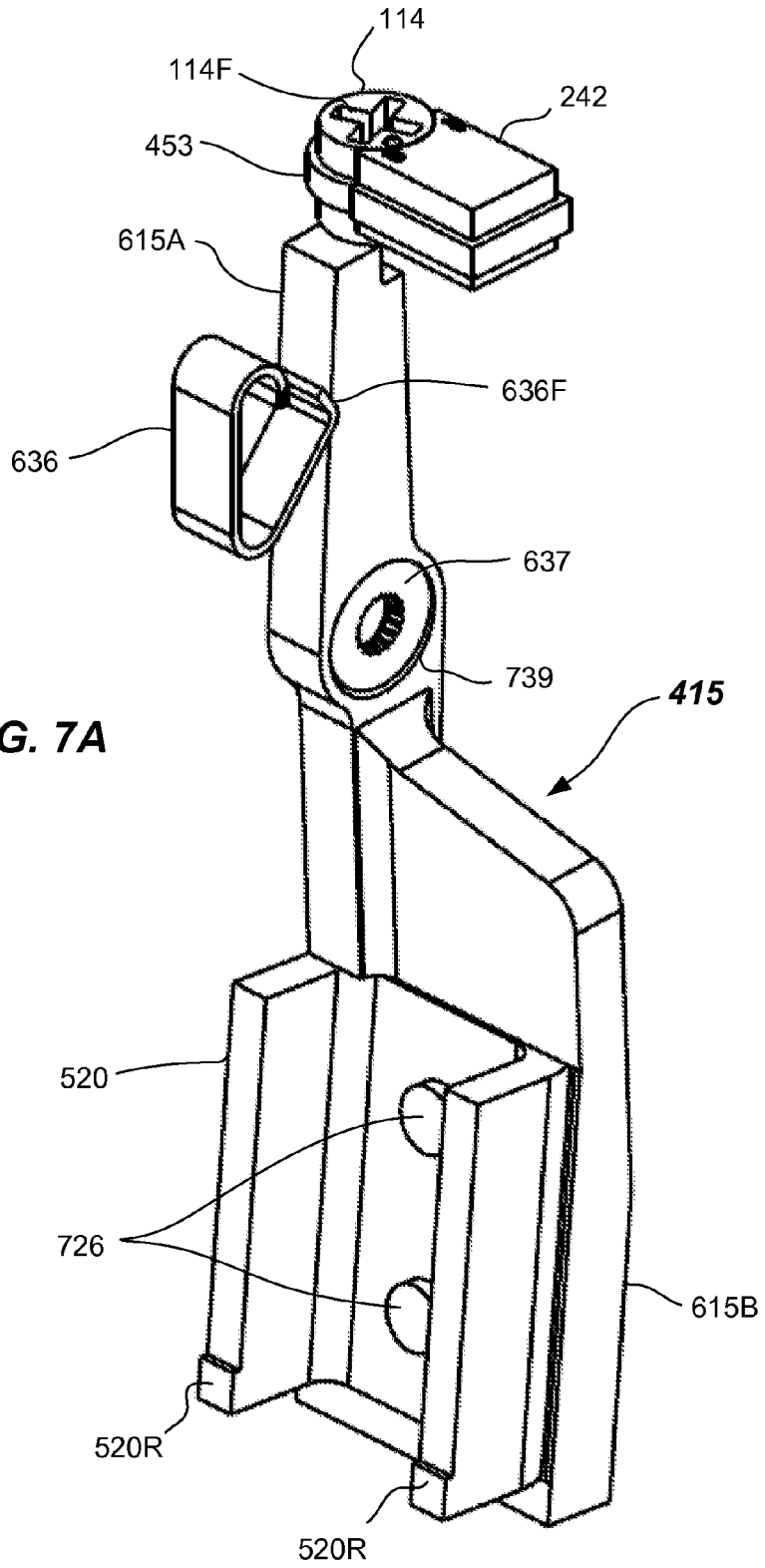
FIG. 7A illustrates an isometric view of some components of a magnet position adjustment mechanism for providing an adjustable instantaneous trip level for a mechanism pole according to one or more embodiments.
Figure 7B:
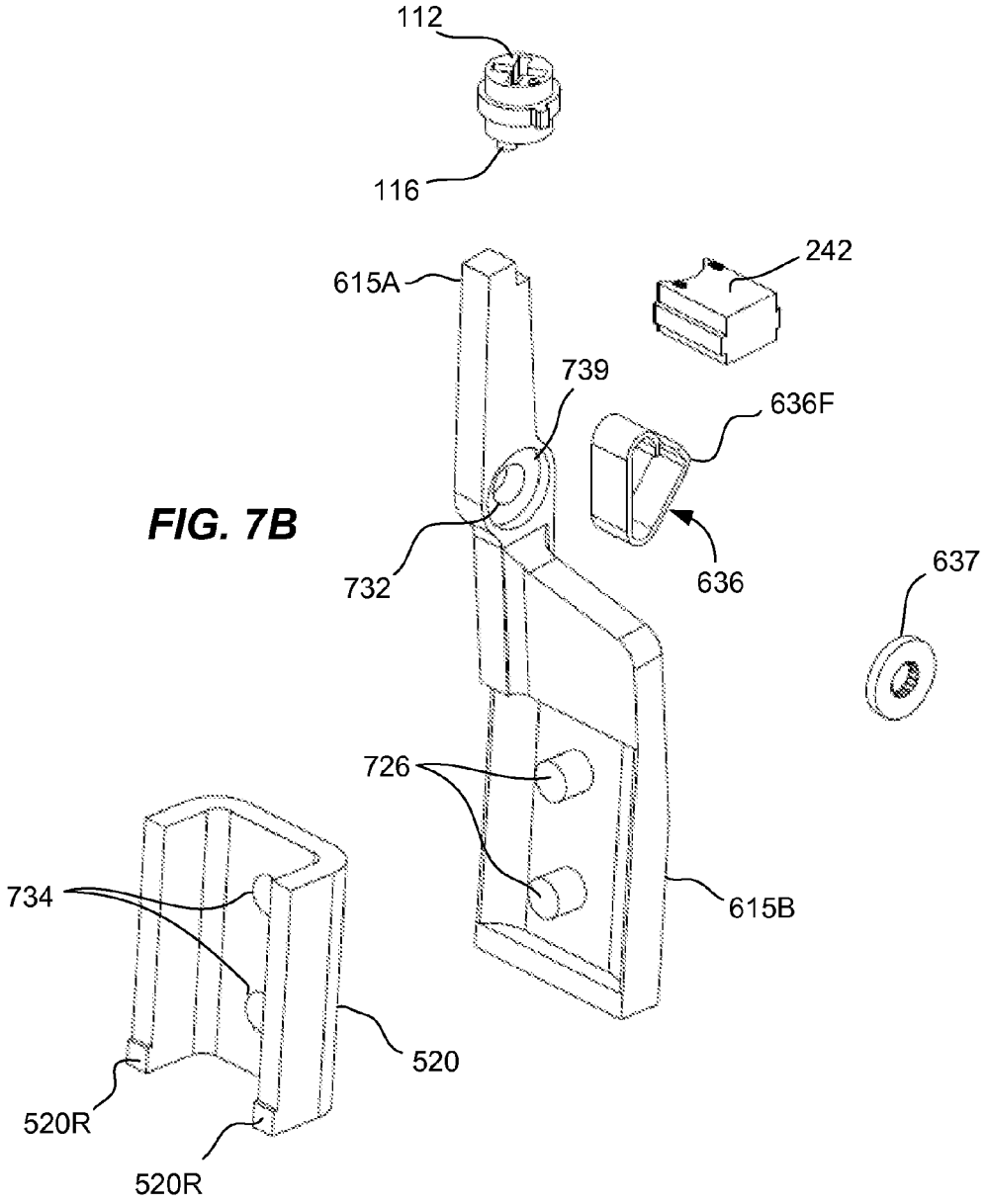
FIG. 7B illustrates an exploded view of some components of the magnet position adjustment mechanism according to one or more embodiments.
Figures 8A, 8B, 8C:
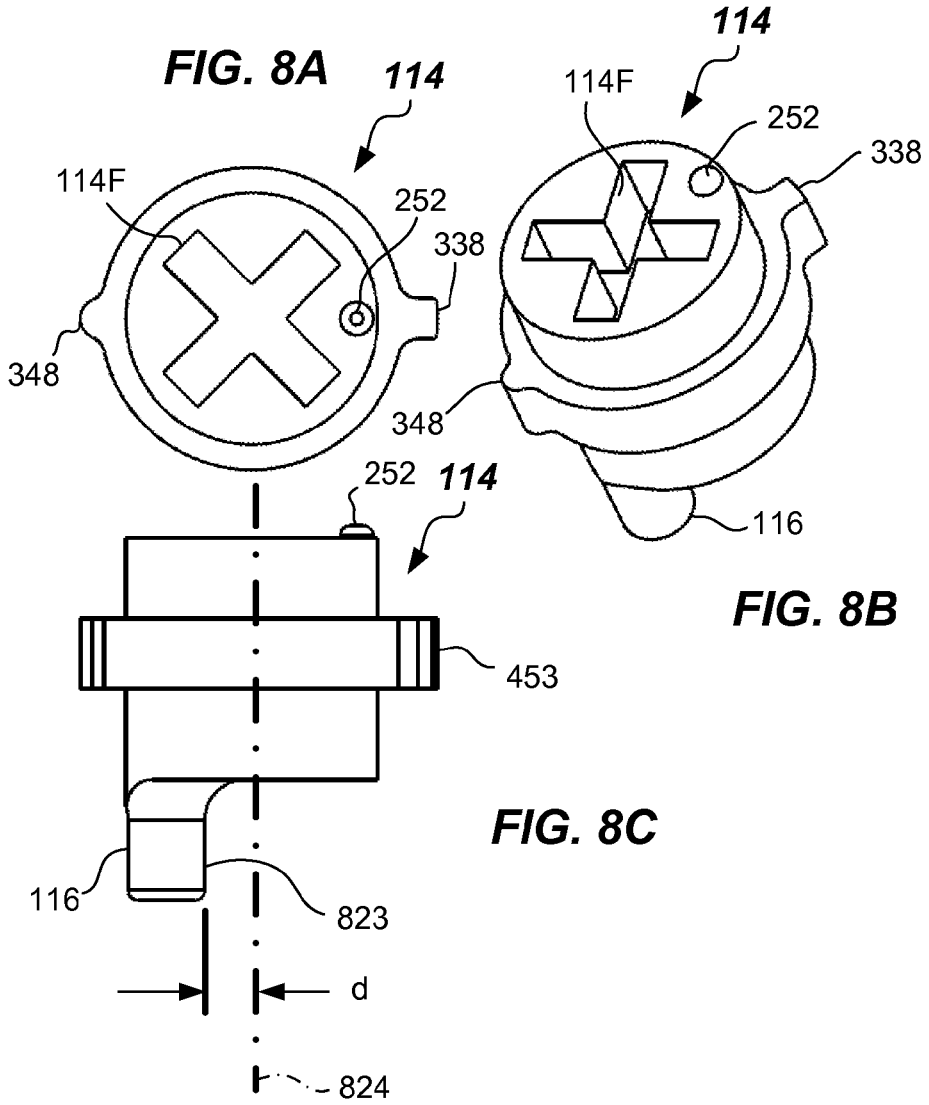
FIGS. 8A-8C illustrates various views of an adjustment knob of a magnet position adjustment mechanism according to one or more embodiments.
Figure 9:
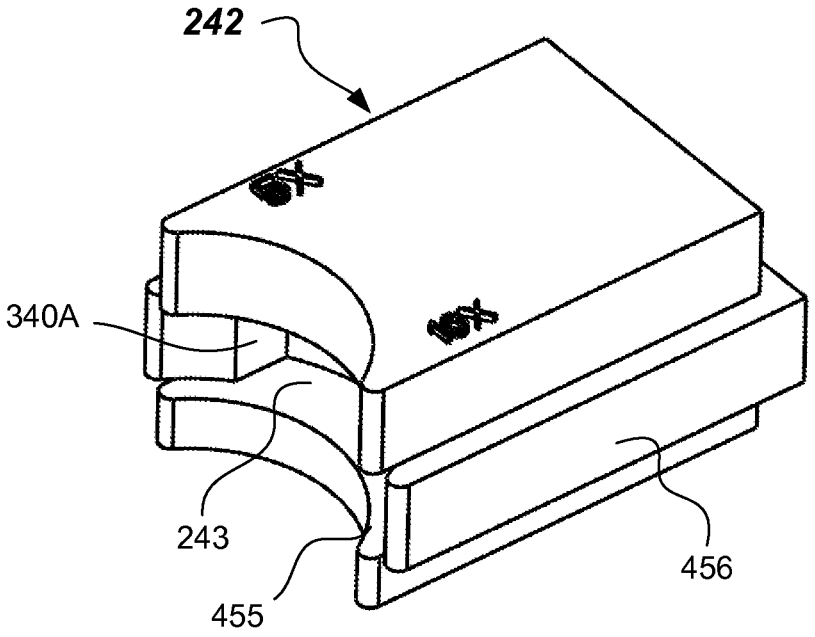
FIG. 9 illustrates an isometric view of an adjustment knob block of a magnet position adjustment mechanism according to one or more embodiments.

As shown in FIGS. 6 through 7B, the magnet carrier 415 includes the first end 615A on a first side of the pivot joint 628 and a second end 615B on a second side of the pivot joint 628, wherein the magnet 520 may be mounted on the second end 615B. A distance to a center of the magnet 520 from the pivot joint 628 may be between about 11.6 mm and 17.7 mm, for example. A distance between the pivot joint 628 and a portion of the first end 615A engaging the cam 116 may be between about 11 mm and 13 mm. Other dimensions may be used.

A return spring 636 may be provided, and may be configured to bias the first end 615A of the magnet carrier 415 into engagement with the cam 116. Any suitable return spring 636 may be used, such as the leaf spring shown. Other types of return spring 636 may be adapted to perform the biasing function, such as a coil spring, wave spring, torsion spring, or the like. Furthermore, although shown engaging the first end 615A, the return spring 636 may be located at any location along the magnet carrier 415 that will provide the biasing contact between the cam 116 and the magnet carrier 415.

As discussed above, a retaining member 637, such as a retaining ring, may be used to secure the magnet carrier 415 onto post 630. Retaining member 637 may fit in countersink 739 formed in the magnet carrier 415. The retaining member 637 may include teeth to deform the post 630 when installed, and may be further secured in place with an adhesive, for example. Alternatively, a push-on type or other fastener could be used.

The return spring 636 may have a suitable shape so that it may be press fit, or otherwise slip onto, a securement member 641 located in the base 346, as shown in FIG. 6. The return spring 636 may be made from a spring steel material, and may include a free end 636F that may engage with a side of the magnet carrier 415 and may function to interface with and maintain contact and spring bias between the cam 116 of the adjustment knob 114 and an end (e.g., first end 615A) of the magnet carrier 415. Return spring 636 may have a spring rate of about 40 to 45 pounds per inch, for example. Other spring rates may be used depending upon the distance from the pivot joint 628. In the depicted embodiment, a distance between the pivot joint 628 and a portion of the first end 615A being engaged by the In the depicted embodiment, a distance between the pivot joint 628 and a portion of the first end 615A being engaged by the return spring 636 may be between about 8.0 mm and 9.0 mm. Other dimensions may be used.

Figure 3:
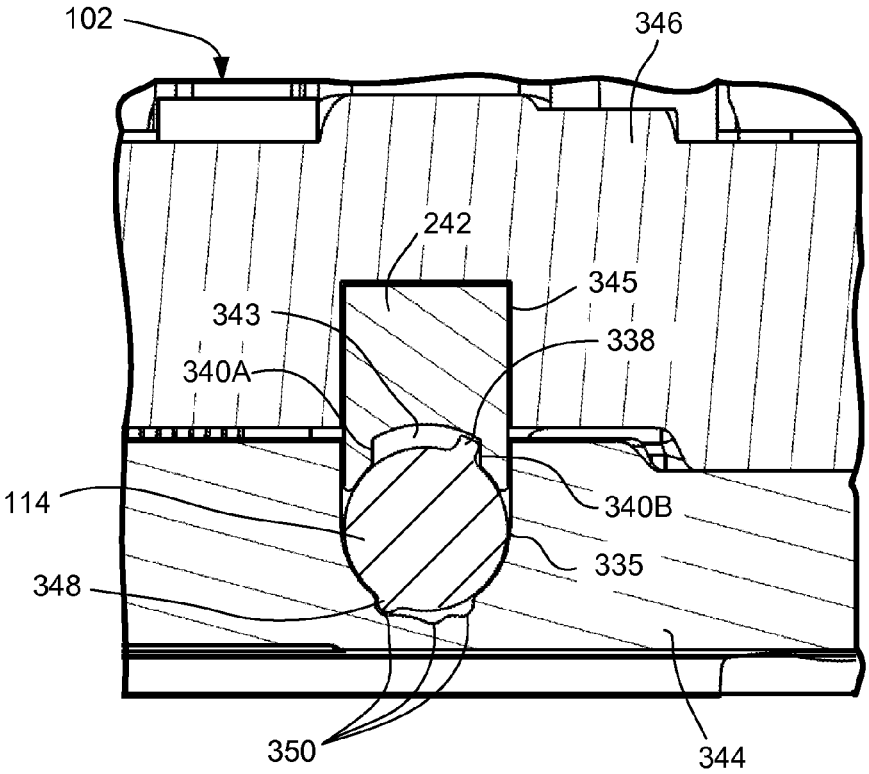
FIG. 3 illustrates a cross-sectioned top partial view of the adjustment knob interfacing with various parts of the molded case including an adjustment knob block and cover in accordance with one or more embodiments.

Referring now to FIGS. 3, 4, 8, and 9 the adjustment knob 114 may include a first stop feature 338 that is engageable with second stop features 340A, 340B. Second stop features 340A, 340B may be formed in an adjustment knob block 242 or elsewhere in the molded case 102. The adjustment knob block 242 may contain a cavity 343 in which the first stop feature 338 may rotate and stop, as needed. The engagement of the first stop feature 338 with second stop features 340A, 340B functions to limit a rotational excursion of the adjustment knob 114 in either direction within rotational limits. The separation between the second stop features 340A, 340B limits the maximum rotation in either direction. Limits may be a rotational excursion of between about 20 degrees and about 30 degrees, for example. Other rotational limits may be used. Adjustment knob 114 may be inserted into, and be rotatable in, a recess 335 of a cover 344 of the mechanism pole 104 in some embodiments, as shown in FIG. 3. Likewise, the adjustment knob block 242 may be inserted into a pocket 345 formed in the base 346 of the molded case 102 of the mechanism pole 104.

In one or more embodiments, the adjustment knob 114 may include an indexing feature 348 that may be engageable with detent features 350 to provide for an incremental adjustment of the instantaneous trip level between two or more values. The indexing feature 348 and detent features 350 interact and engage to lock the adjustment knob 114 into multiple preset positions. For example, the incremental adjustment may include at least increments of five times (5×) and ten times (10×) of the handle rating of the circuit breaker 100. Other increments may be provided as well including, for example, one or more of 6×, 7×, 7.5×, 8×, and 9×. Other increments may be used.

As shown in FIGS. 2 and 8A-8C, a top of the adjustment knob 114 may include an indicator feature 252, such as a mark or other indicia, configured to align the adjustment knob 114 with the setting indicators 253 (e.g., 5× or 10×) provided on the adjustment knob block 242 (or optionally on the base 346).

Figure 10A:
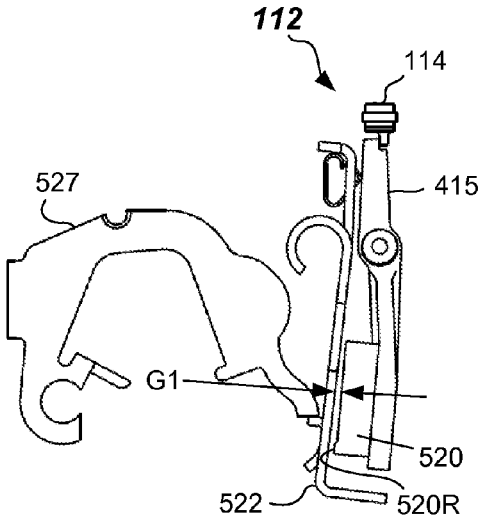
FIGS. 10A-10C illustrates several views with an adjusted small, medium, and large air gap between the armature and the magnet demonstrating the air gap adjustment capability of the magnet position adjustment mechanism according to one or more embodiments.
Figure 10B:
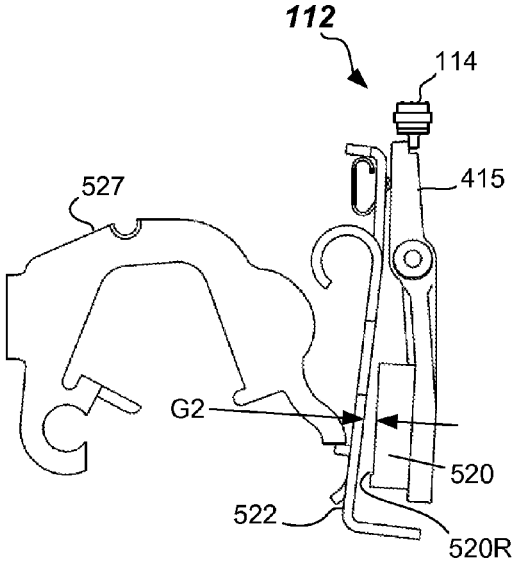
Figure 10C:
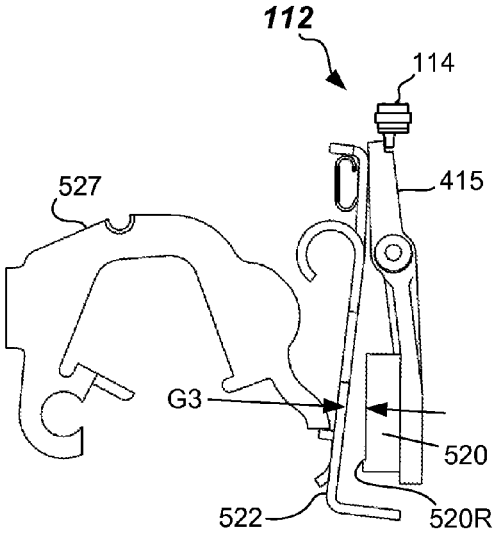

The rotation of the adjustment knob 114 may be accomplished by inserting a screw driver or other implement into the turning feature 114F located on the top of the adjustment knob 114. Rotating the adjustment knob 114 between the limits (e.g., 5× and 10× settings) will increase or decrease the air gap "G" between the magnet 520 and armature 522 as shown in FIGS. 10A-10C.

As the adjustment knob 114 is rotated, detent features 350 formed or provided in the cover (or optionally, the base 346) interface with the indexing feature 348. As best shown in FIGS. 3 and 4, the adjustment knob 114 is held in place by the surrounding geometry and the interaction of the indexing feature 348 and the detent features 350. In particular, retention features of the base 346 (e.g., grooves) and cover 344 (e.g., grooves) may secure the adjustment knob 114 in position, as well as the adjustment knob block 242.

The adjustment knob block 242 may include a first retention feature 453, such as a rib, that interfaces with a second retention feature 454, such as a groove or grooves formed in the base 346 and/or cover 344, for example. The adjustment knob 114 may include, for example, a rib as the first retention feature 453 that extends entirely or part way around the body of the adjustment knob 114. Rib may interface with the second retention features 454 on the cover 344 and even third features 455 (e.g., a groove) formed on the adjustment knob block 242. This rib located on the adjustment knob 114 engages with the grooves on the cover 344 and the adjustment knob block 242 to secure the adjustment knob 114 in place after assembly. Likewise, the adjustment knob block 242 may include fourth retention features 456 (e.g., ribs) that interface with fifth retention features 457 (e.g., grooves) to retain the adjustment knob block 242 in the molded case 102 (e.g., in the base 346).

Figure 5:
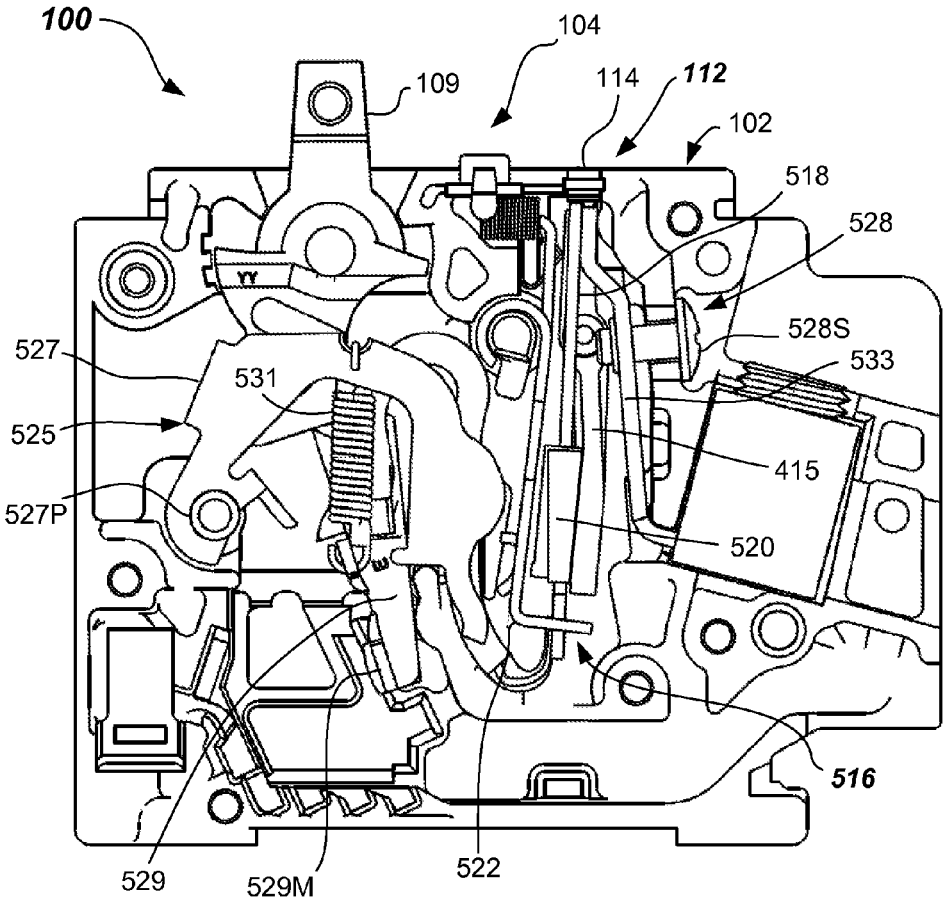
FIG. 5 illustrates a side view of the mechanism pole (with cover removed) showing the components of a magnet position adjustment mechanism and the components of the tripping assembly according to one or more embodiments.

According to one or more embodiments, a circuit breaker 100 (e.g., a residential circuit breaker) including a mechanism pole (e.g., mechanism pole 104) containing, as shown in FIG. 5, a thermal and magnetic mechanism 516 is provided. Thermal and magnetic mechanism 516 is configured to adjust thermal tripping of the circuit breaker 100. Thermal and magnetic mechanism 516 includes a bimetal 518, magnet 520, and armature 522 as is conventional, except that in embodiments of the present invention, the bimetal 518 is not attached to the magnet 520. Bimetal 518 is disconnected from the magnet 520. The ramifications of this construction will become apparent below. The mechanism pole (e.g., 104 and/or 106) and the thermal and magnetic mechanism 516 may be part of an electronic circuit breaker including an electronic pole 108 (either one-pol or two-pole). In one or more embodiment, the circuit breaker 100 may be a two-pole circuit breaker and may comprise the mechanism pole 104 and a second mechanism pole 106 containing a second thermal and magnetic mechanism (identical to thermal and magnetic mechanism 516) that is independently adjustable.

In one or more embodiments, magnet position adjustment mechanisms may be provided in a two-pole circuit breaker 100 as shown in FIG. 1. In this embodiment, the first mechanism pole 104 contains the first thermal and magnetic mechanism 516 including a bimetal 518, magnet 520, and armature 522, and a magnet position adjustment mechanism 112 configured to provide an adjustable instantaneous trip level of the first mechanism pole 104 via movement the magnet 520 to adjust a first air gap between the magnet 520 and the armature 522. Two-pole circuit breaker also includes a second mechanism pole 106 containing a second thermal and magnetic mechanism (identical to first thermal and magnetic mechanism 516) including a second bimetal, second magnet, and second armature (each identical to bimetal 518, magnet 520, and armature 522), and a second magnet position adjustment mechanism that may be identical to the magnet position adjustment mechanism 112 or a mirror image thereof. Second magnet position adjustment mechanism may be configured to provide an adjustable instantaneous trip level of the second mechanism pole 106 via movement of the second magnet to adjust a second air gap between the second magnet and the second armature In one tripping sequence, i.e., thermal tripping, the thermal and magnetic mechanism 516 is adapted to trip the circuit breaker 100 when the bimetal 518 heats to a certain heating level due to a persistent electrical overcurrent condition. The heating (resistive heating) causes bending of the bimetal 518 due to differential coefficients of expansion of the metal strips making up the bimetal 518, and causes the end of the bimetal 518 to engage with the armature 522. After sufficient heating and bending, a tripping mechanism 525 will be released. Tripping mechanism 525 includes conventional components such as cradle 527 pivotable about cradle pivot 527P, moveable contact arm 529 including moveable electrical contact 529M, and cradle spring 531 connecting cradle 527 and moveable contact arm 529. Also shown is a thermal calibration mechanism 528 which is operable to adjust the thermal tripping of the circuit breaker 100. Thermal calibration mechanism 528 includes an adjustment screw 528S which threads into strap 533. Adjustment of the adjustment screw bends the strap 533 between points on then housing 102 and calibrates the thermal trip level to a desired value, such as between a range of values.

The present thermal and magnetic mechanism 516 is configured to adjust thermal tripping of the circuit breaker 100, as was the case in the prior art. However, as discussed above, in prior art circuit breakers including conventional structure, a thermal calibration mechanism adjustment not only adjusts the thermal trip point, but also may affect the instantaneous trip level of the circuit breaker. This is not the case with embodiments of the invention. In the instant thermal and magnetic mechanism 516 of the circuit breaker 100, the bimetal 518 is not connected to the magnet 520 and the position of the magnet 520 may move relative to the bimetal 518. This has the advantageous effect of making the instantaneous trip level insensitive to thermal calibration mechanism adjustments.

FIGS. 10A-10C illustrates the magnet position adjustment mechanism 112 with a small air gap G1, a medium air gap G2, and a large air gap G3. During an instantaneous trip condition or event in one mechanism pole (e.g., mechanism pole 104 or 106), the armature 522 is attracted to the magnet 520 by a magnetic force that is generated in the magnet 520 as current flows thru the current path including the bimetal 518 of the circuit breaker 100. This attraction varies depending on the air gap G between the armature 522 and magnet 520. Rotating the adjustment knob 114 of the magnet position adjustment mechanism 112 can increase or decrease this air gap G as shown in table 1 below. This changes the instantaneous trip level.

TABLE 1

| Air gap adjustment | | |
|---|---|---|
| Knob Position | Air gap (G) | Factor of Breaker Handle Rating |
| 1 | 0.020 inch | 5X |
| 2 | 0.052 inch | 7.5X |
| 3 | 0.096 inch | 10X |

As shown, due to the magnetic attraction, the armature 522 rotates in a counterclockwise direction and touches the magnet raised features 520R. The small area of contact between the magnet 520 and armature 522 reduces the magnetic attraction force once the current is broken. This armature rotation decreases the cradle 527 to armature 522 latch bite. When the latching surface becomes too small to maintain, the cradle 527 is released and rotates clockwise and the tripping mechanism 525 will open the contacts and break the circuit.

Figure 11A:
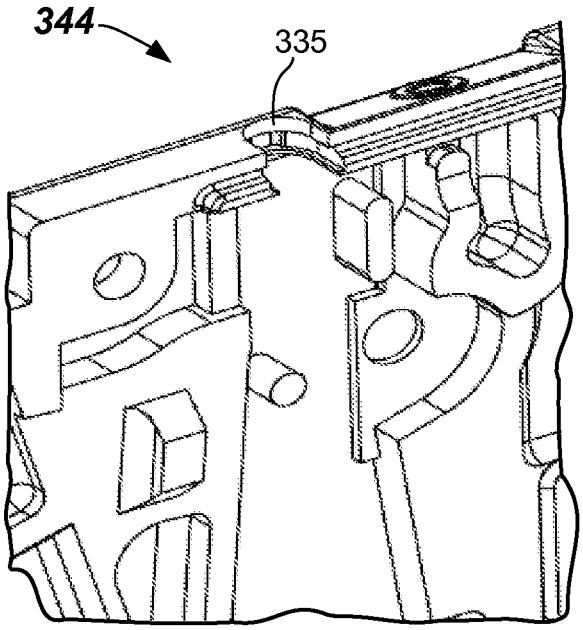
FIGS. 11A and 11B illustrates structural features of a base and cover configured to accept an adjustment knob and an adjustment knob block, respectively, according to one or more embodiments.
Figure 11B:
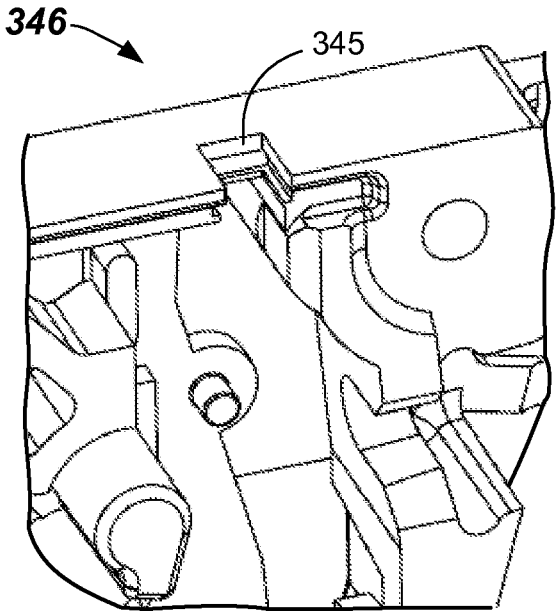

FIGS. 11A and 11B illustrate partial isometric views of the cover 344 and base 346, respectively, of the molded case 102 (FIGS. 3 and 4). Illustrated are the pocket 345 in the base 346 that accepts the adjustment knob block 242 (FIG. 9) and the recess 335 that accepts the adjustment knob 114.

Figure 12:
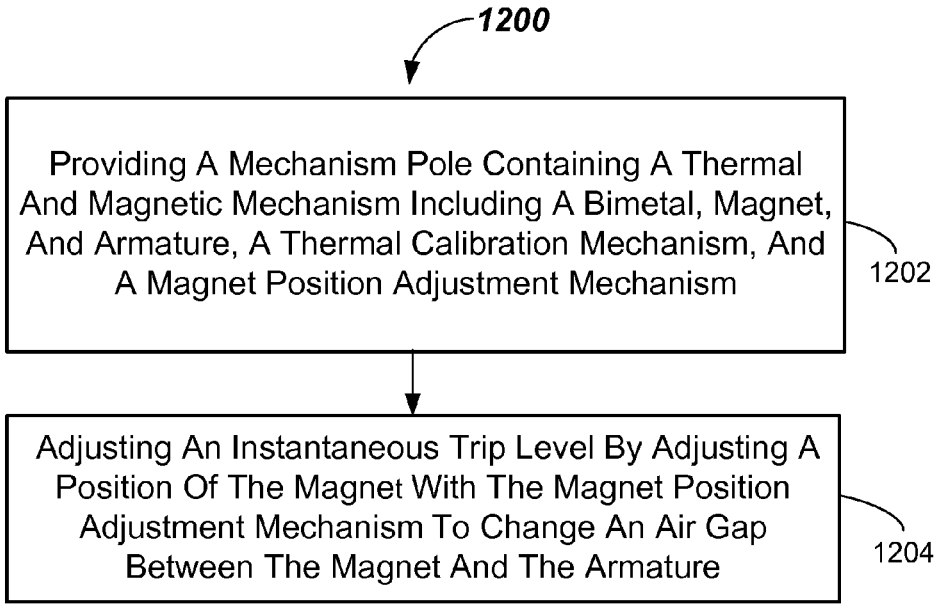
FIG. 12 illustrates a flowchart of a method of adjusting a circuit breaker according to one or more embodiments.

Referring now to FIG. 12, a method of adjusting a circuit breaker 100 is provided. The method 1200 includes, in 1202, providing a mechanism pole (e.g., mechanism pole 104 or 106) containing a thermal and magnetic mechanism (e.g., thermal and magnetic mechanism 516) including a bimetal (e.g., bimetal 518), magnet (e.g., magnet 520), and armature (e.g., armature 522), a thermal calibration mechanism (e.g., thermal calibration mechanism), and a magnet position adjustment mechanism (e.g., magnet position adjustment mechanism 112).

The method 1200 includes, in 1204, adjusting an instantaneous trip level by adjusting a position of the magnet (e.g., magnet 520) with the magnet position adjustment mechanism (e.g., magnet position adjustment mechanism 112) to change an air gap (e.g., air gap G) between the magnet (e.g., magnet 520) and the armature (e.g., armature 522).

While the invention is susceptible to various modifications and alternative forms, specific embodiments and methods thereof have been shown by way of example in the drawings and are described in detail herein. It should be understood, however, that it is not intended to limit the invention to the particular apparatus, systems or methods disclosed, but, to the contrary, the intention is to cover all modifications, equivalents and alternatives falling within the scope of the invention.

What is claimed is:

1. A circuit breaker, comprising:

a mechanism pole containing a thermal and magnetic mechanism including a bimetal, a magnet, and an armature;

a thermal adjustment mechanism configured to adjust thermal tripping of the circuit breaker; and a magnet position adjustment mechanism configured to provide an adjustable instantaneous trip level via moving the magnet to allow adjustment of an air gap between the magnet and the armature, wherein the magnet position adjustment mechanism comprises:

an adjustment knob that is externally adjustable, the adjustment knob including a cam, a magnet carrier including a pivot and a first end engageable with the cam, and mounting features configured to mount the magnet on the magnet carrier.

2. The circuit breaker of claim 1, wherein the mechanism pole and the thermal and magnetic mechanism are part of an electronic circuit breaker including an electronic pole.

3. The circuit breaker of claim 1, wherein the mounting features comprise one or more magnet carrier posts and the magnet includes one or more holes, wherein the one or more holes are received over the one or more magnet carrier posts.

4. The circuit breaker of claim 1, wherein the pivot comprises a post integral with a molded case, and an aperture formed in the magnet carrier.

5. The circuit breaker of claim 1, wherein the magnet carrier comprises the first end on a first side of the pivot and a second end on a second side of the pivot, wherein the magnet is mounted on the second end.

6. The circuit breaker of claim 5, comprising a return spring biasing the first end into engagement with the cam.

7. The circuit breaker of claim 1, comprising an adjustment knob.

8. The circuit breaker of claim 7, wherein the adjustment knob comprises a first stop feature engageable with second stop features of an adjustment knob block to limit a rotational excursion of the adjustment knob within limits.

9. The circuit breaker of claim 7, wherein the adjustment knob comprises an indexing feature engageable with detent features to provide incremental adjustment of instantaneous trip level.

10. The circuit breaker of claim 1, wherein incremental adjustment comprises at least increments of 5× and 10× of a handle rating of the circuit breaker.

11. The circuit breaker of claim 1, comprising an adjustment knob block.

12. The circuit breaker of claim 11, wherein the adjustment knob block is received in a pocket formed in a molded case.

13. The circuit breaker of claim 1, comprising an adjustment knob located on a front surface of a molded case of the mechanism pole.

14. The circuit breaker of claim 1, comprising a molded case comprises a base and a cover wherein an adjustment knob and an adjustment knob block are retained by the base and the cover.

15. The circuit breaker of claim 1, wherein the circuit breaker is a two-pole circuit breaker and comprises the mechanism pole and a second mechanism pole containing a second thermal and magnetic mechanism that is independently adjustable.

16. The circuit breaker of claim 1, wherein the thermal adjustment mechanism is adjustable without affecting the instantaneous trip level.

17. The circuit breaker of claim 1, wherein the thermal and magnetic mechanism comprises a configuration where the bimetal is freely moveable relative to the magnet.

* * * * *